US005645500A

United States Patent [19]

Borden

[11] Patent Number: 5,645,500

[45] Date of Patent: Jul. 8, 1997

[54] GOLF TOOL

[76] Inventor: Teddy H. Borden, 315 W. Braeside, Arlington Heights, Ill. 60004

[21] Appl. No.: 717,571

[22] Filed: Sep. 23, 1996

[51] Int. Cl.[6] ..... A63B 57/00

[52] U.S. Cl. ..... 473/408; 473/386; 473/286

[58] Field of Search ..... 473/408, 286, 473/386, 282, 407, 405; D21/234; 15/105, 236.01; 172/378, 379, 380; 248/156

[56] References Cited

U.S. PATENT DOCUMENTS 4,535,987 8/1985 Dikoff ..... 473/408

4,896,883 1/1990 Wagenknecht ..... 473/386

5,226,647 7/1993 Notarmuzi ..... 473/286

5,292,120 3/1994 Pehoski et al. ..... 473/286

*Primary Examiner*—Steven B. Wong

*Attorney, Agent, or Firm*—Michael J. Femal

[57] ABSTRACT

A multipurpose golf tool having an unique construction that makes it easy to incorporate multiple features and functions within a single, rigid and generally flat body section that fits in the palm of the golfer hand yet can be stored in a pocket without causing damage to the clothing.

6 Claims, 1 Drawing Sheet

GOLF TOOL

TECHNICAL FIELD

The invention relates generally to a golfer's tool, and more particularly to a golfer's tool having a multiplicity of applications within a single tool. that dramatically increases functions in a compact and easily carried hand tool.

BACKGROUND ART

The present day golfer wants a hand tool that performs many different functions but yet remains easy to use and is compact enough to fit into a pocket in a golf shirt or slacks. Anybody who has played golf in the early mornings to dusk has experienced varying playing conditions such as damp and muddy in the early mornings to dry and dusty in the late afternoon sunshine. Golf shoes need to have mud removed from the cleats and damaged cleats changed. Golf clubs, especially irons, need their grooves continuously cleaned when taking a divot during a golf shot while the turf is in muddy or wet conditions. Soft greens dimple and leave a ball mark when pitching a lofted golf shot onto them whether the conditions are wet or dry on the golf course. Especially, in the early morning dew or when the groundskeeper waters the course, a golfer who has taken several clubs from the golf bag or cart to use in and around the green wants to keep the grips and shaft of the clubs off the wet ground which can be damaged by the corrosive water that accumulate in and around the green that contains various chemical fertilizers and the like in it. Often a cleat or spike becomes damaged on a golf shoe and needs to be removed from the golf shoe during a round of golf. When an attempt is made to remove the cleat, there is often dried mud and debris in the holes surrounding the spike that can be rock hard. A spike hole reamer of some type is required to free this debris so the cleat or spike can be removed quickly between holes before using the spike wrench to twist off the spike. There are times during every round of golf when the ground at one of the tee boxes is very hard and pancaked such that the placement of a golf tee in the ground becomes difficult at best or results in a number of broken tees and scraped fingers. Also upon striking the golf ball, the tee becomes buried in the ground especially if the golfer tops the ball on his drive off the tee box making it virtually impossible for the golfer to retrieve the tee stuck in the ground with its head below the surface. In both of these instances, a tool of some type is required to place the tee in the ground at varying heights for an iron or wood shot or to remove a buried tee from the ground after the golf shot. And of course during most rounds a beverage or two maybe purchased that has a cap on it requiring a bottle opener or a pop top tab on it requiring a grabber or the like. Nothing is worse than cutting an expensive leather golf glove or, even worse, cutting a finger when attempting to remove a pop top tab that usually are sharp along their edges. Each of these above highlighted and well known conditions is familiar to those who play the game of golf and each instance requires a separate tool that can take up valuable space in the golf bag or load down a number of pockets that are needed for other items during a round of golf Prior art reveals several different types of golf tools that take care of one or more of the above problems but do not take care of them all or creates a golf tool that can become damaging to the golfer's shirt and pants pockets when stored therein. Such golf tools are shown in U.S. Pat. No. 5,292,120 (GOLF TOOL) and U.S. Pat. No. 5,226,647 (MULTI-PURPOSE GOLF ACCESSORY).

While both of these prior art devices address at least some of the aspects of the present invention such as portability and storage in a single golf tool, both the '120 and '647 patents lack the total number of multiple feature and functions provided by the present invention. The spike hole reamer, spike cleaner and buried tee puller functions are missing from the functions that these prior art devices can perform. None of these cited

SUMMARY OF THE INVENTION

Accordingly, an important object of the present invention is to provide a multipurpose golf tool that is shaped to easily perform all of the normal functions that a golfer might encounter in his round of golf despite the varying weather conditions.

A further object of the invention is to provide a sturdy, portable, easily manipulated golfer's tool that fits in the palm of his had but can be placed in a pocket without sharp edges or protrusion that can damage clothing.

Another object of the invention is to provide a golfer's tool that combines multiple tool functions but yet is a simple one piece construction with rounded edges to avoid damage to clothing and the like.

In the preferred embodiment of the invention, the invention is comprised of a unitary golfer's tool for removing and tightening spikes or cleats including the removal of debris in the spike holes before insertion of the spike wrench feature, fixing ball marks and divots on the greens, cleaning golf shoe spikes, removing mud and debris from the face and grooves of the club heads of the irons and woods, setting golf tees in the ground at the tee boxes for iron and wood golf shots, removing buried golf tees, providing a club grip rest in and around the greens or fairways, opening bottle caps and pulling pop top tabs off of cans and the like; thus the golfer's tool of the present invention provides multiple tool functions and features to meet the varying needs of a golfer during a round of golf.

Other features and advantages of the invention, which are believed to be novel and nonobvious, will be apparent from the following specification taken in conjunction with the accompanying drawings in which there is shown a preferred embodiment of the invention. Reference is made to the claims for interpreting the full scope of the invention which is not necessarily represented by any one embodiment.

DETAILED DESCRIPTION

Although this invention is susceptible to embodiments of many different forms, a preferred embodiment will be described and illustrated in detail herein. The present disclosure exemplifies the principles of the invention and is not to be considered a limit to the broader aspects of the invention to the particular embodiment as described.

Figure 1:
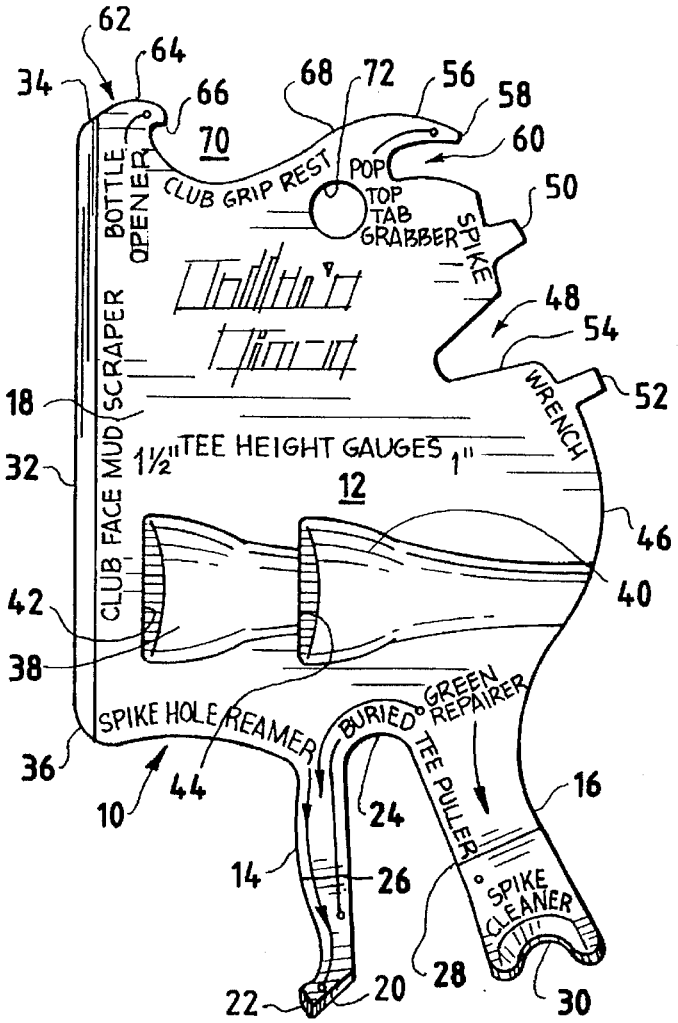
FIG. 1 is a frontal view of the golfer's tool according to the present invention.

FIG. 1 shows a frontal view of one embodiment of a golfer's tool 10 which includes a generally flat body 12 having irregularly shaped, downwardly extending legs 14 and 16. In one embodiment the legs 14 and 16 are extending approximately seven eighths of an inch (⅞") below the main portion 18 of the body 12 and the overall length including the legs 14 and 16 and the body 12 is three inches (3")long and one and three quarters inches (1¾") wide.

In this embodiment, the golfer's tool 10 is stamped out of a suitable gauge cold rolled steel or the like that is heat treated, deburred and polished. The tool 10 is then plated with copper, nickel and chrome or other suitable finishes to provide a high quality tool that is very durable, shiny, and long lasting finish that naturally sheds dirt while being easy to clean. Other lighter materials like plastic, aluminum and the like are unsuitable for the golfer's tool 10 because they lack the rigidity to function as a spike or cleat wrench or may break when place in a pants pocket and sat upon.

Figure 2:
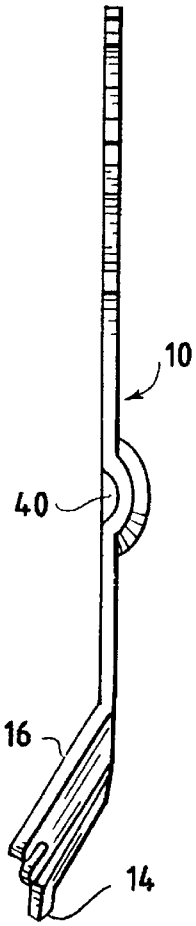
FIG. 2 is a side view of the golfer's tool of FIG. 1.

Referring now to FIGS. 1 and 2, the legs 14 and 16 are irregularly shaped and differently sized from one another. Leg 14 is smaller in width from leg 16 for several functional reasons. Leg 14 extends downwardly approximately half of its length before angling gently upwardly at less than a forty five(45) deuce angle from the generally flat body 12 and main portion 18. The leg 14 terminates in a foot 20 having a toe 22 smaller than a spike hole that extends away from the leg 16 in order to insert the toe 22 into a spike or cleat hole to clean the debris thereout before using a spike wrench feature to be described later.

The leg 16 extends downwardly and generally away from leg 14 a predetermined distance to form an arch 24 therebetween. Leg 16 bends upwardly from the flat body 12 at an angle similar to the leg 14 to allow the golfer to manipulate the legs beneath the surface of the ground on a buried tee and under the head of the tee. Then as the golfer pushes the legs 14 and 16 further underneath the head of the tee the tee rises upwardly on its tapered shaft as the space between legs 14 and 16 decreases causing the mechanical lift of the tapered shaft of the tee as it rides down the legs to the apex of the arch forcing the tee upwardly and out of the ground. Initially, the underside of the head and the tapered shaft of the buried tee slidably engages the inner sides 26 and 28 of legs 14 and 16, respectively, and cause the tee to be leveraged upwardly and out of the ground as the golfer pushes the legs further into the ground around the tapered tee shaft. The unique angled and arch formed by the legs 14 and 16 give the golfer a mechanical leverage and advantage in removing buried tees without permanently damaging the ground at the tee box.

In addition, leg 16 terminates in a beveled arch 30 that fits around the spike or cleat to lift turf and mud that collects around the spikes and cleats during a round of golf. Quite often it is to the golfer's advantage to remove the collected tuff from the spikes before he walks onto the green so that his feet are perfectly flat on the putting surface. Without this cleaning feature it becomes more difficult to clear the debris from the cleats.

The leg 16 with its beveled arch 30 makes a good green repair to fix ball marks on the green caused by lofted golfs thereon. The legs 14 and 16 together help to repair bigger divots on the fairway and around the green surface.

Next referring to FIGS. 1–4, the body portion 18 includes a straight beveled edge 32 that runs approximately two (2") long down the left side of the tool as viewed in FIG. 1. The beveled edge 32 fits into the typical groove in an iron or wood so that the groove can be cleaned by running either a rounded corner 34 or 36 at each end of the edge 32 across the grooves on the club face. In addition, the edge 32 with its length of approximately two inches in length provides an excellent club face scrapper that generally can clean the entire club face with a single swipe across its face. The rounded comers 34 and 36 also prevent the edge 32 from cutting or ripping a pocket that it is stored in. This feature is often used throughout a round of golf because the club face of a golf club often collects mud and other debris on irons and woods hit from the fairways that cakes onto the face as well as the horizontal grooves across a club's face. These grooves need to be cleaned before the next shot is attempted or otherwise the debris could misdirect the golf shot.

Next as shown in FIGS. 1–4, the body portion 18 includes a pair of spaced apart indentations 38 and 40 in the shape of a golf tee head and a portion of the tapered tee shaft that extends generally horizontally across the body portion 18 in FIG. 1. A head end 42 of the indentation 38 cuts across approximately one third of the golf tee head and the tee is held in place within the indentation 38 by the golfer's thumb across the tapered shaft of the golf tee just below its head. Then the golf tee is pushed into hard ground or the like at the tee box with its tip and tapered shaft extending approximately ¾ of an inch into the ground for a tee shot with a driver until a curved fight side 46 of the body portion 18 touches the surface of the ground. Next, if the golfer wants to tee the golf ball up higher, the tee is inserted into the golf tee indentation 40 and held the same way with the golfer's thumb and pushed into the ground by a head end 44 covering approximately ⅓ of an inch across the tee head. This time the tee tip and shaft are pushed approximately 1½ inches into the ground meaning the golf ball resting on the head of the tee is closer to the ground when a typical tee of 2 and 3/16 inches long is used by the golfer. The importance of this feature for teeing up balls is the uniformity in the height of the teed golf ball which means a more consistent swing and striking of the ball than having the ball teed a various different and random heights each time that the golfer tees up the ball in a tee box. Consistency is very important to improving ones golf score so this eliminates one more variable in the game.

The next feature of importance in this unique golfer's tool made according to the invention is a spike wrench 48. The spike wrench includes a pair of protrusions 50 and 52 on opposing sides of a cone shaped spike cavity 54 therebetween. For a right handed person the thumb goes on the back side of the body portion 18 as shown in FIG. 1 with the index finger of the hand opposing the thumb on the front side or running abreast of the golf tee indentations 38 and 40. Next, the middle finger is placed adjacent and across the midsection of each leg 14 and 16 approximately where the legs bend upwardly in order to achieve leverage and torque forces as the protrusions 50 and 52 are inserted into the spike holes with the spike tip extending upwardly into the cone space of the cavity 54 and twisted.

Referring back to FIGS. 1, 3 and 4, a pull pop top tab opener or grabber 56 protrudes like a finger in a gradual arc from a top fight portion of body 18 toward the spike wrench protrusion 50 and terminating in a rounded point 58 that in conjunction with the body portion 18 and protrusion 50 forms a pop top tab cavity 60 within the body portion 18. The golfer inserts the protruding grabber 56 underneath the tab and pulls it backwardly removing the pop top tab from the can or beverage container without touching the metal tab with a finger and avoiding the potential of cutting the finger on the edges of the tab. On a left top portion of body 18, a bottle opener 62 is formed by a protrusion 64 arcing in the same direction as the grabber 56. Unlike the grabber 56, the protrusion 64 is blunted and terminates in a hook 66 that is inserted underneath a cap on a bottle. Between the hook 66 and the grabber 56 is a swale 68 that allows the edge of the cap, its side and top to engage the swale for mechanical advantage to pry off the bottle cap.

Figure 3:
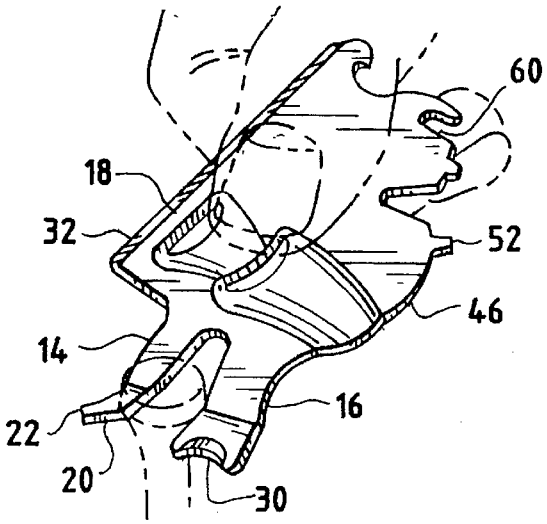
FIG. 3 is an isometric view of the inventive golfer's tool shown in a generally flat or horizontal position.
Figure 4:
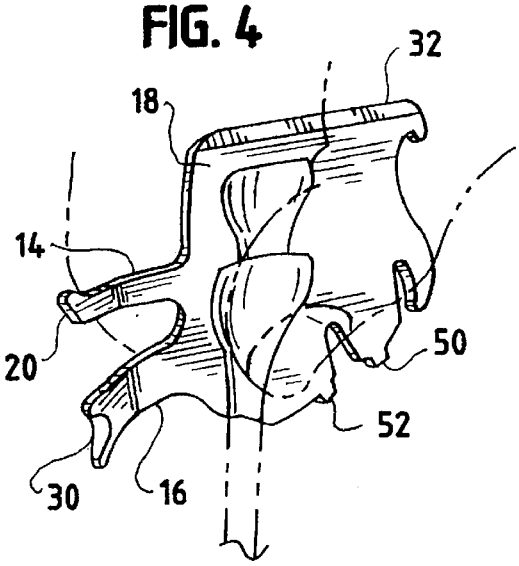
FIG. 4 is an isometric view of the inventive golfer's tool shown in upright position.

Finally, the bottle opener 62 and the grabber 56 with the swale 68 therebetween form a club grip rest 70. A golfer plants the legs 14 and 16 into the ground placing the body 18 in a generally upright position with the rest 70 at the top. A golfer then places the club grip into the cradle of the club grip rest 70 keeping it from being exposed to moisture and water that can ruin the leather or synthetic grips and the chromed club shafts. Further, as shown in FIGS. 1, 3 and 4, a hole 72 located on the upper fight body 18 adjacent the grabber 56. The golfer can then use this hole 72 to attach the multipurpose golf tool to a chain or other tether.

Having described and illustrated the principles of the invention in a preferred embodiment thereof, it should be apparent that the invention can be modified in arrangement and detail without departing from the spirit and scope of the invention as claimed.

I claim:

1. A multipurpose golf tool comprising:

an elongated generally flat body section having a top, two vertical sides and a bottom, a pair of generally irregularly shaped legs extending downwardly and slightly angled apart from one another and connected to the bottom of said body section, one of said legs terminating in a foot having a toe pointing away from the other leg to form a spike hole reamer, said other leg having a width greater than said one leg and terminating in a beveled concave end for cleaning debris from a spike and repair ball marks on the greens, said pair of legs joining at an arch at the bottom of said body section and providing a means of leveraging a buried tee out of the ground as the tee slides between the angled legs toward said arch, a straight beveled edge extending approximately the vertical length of one side of the body section and terminating in rounded corners at either end thereof for cleaning the golf club face and its grooves therein, respectively, a pair of tee shaped indentations in line with one another in a generally horizontal arrangement across said body section for engaging the head and a portion of the tapered shank of a tee for placing it into the ground despite the hardness of the ground at the tee box and for placing the tee head and the golf ball at a consistent and predetermined height above the ground for a tee shot, a spike wrench having a pair of spaced apart shoulders on the generally upper fight hand portion of the body section extending outwardly from the side opposite said straight beveled edge in a direction generally perpendicular to said legs, a pair of protrusions on the outermost ends of each shoulder to accommodate holes in the base of golf spikes, said shoulders having a spike cavity therebetween extending into the body section so that the golfer achieves leverage between the spike wrench protrusions in the spike holes and the legs when twisting on or off the spike in the golf shoe, a pop top tab grabber located in the upper right hand corner of the body section having a finger extending in an are toward the upper shoulder and spike wrench protrusion for pulling pop top tabs off a beverage can without touching a digit on the golfer hand, a bottle opener on the upper left hand corner having a blunted protrusion extending in the direction of the finger ending in a hook for pulling off a bottle cap and a swale between the bottle opener and grabber having a generally concave shape for receiving a club grip therein when the legs are placed into the ground to hold the body section in a generally perpendicular alignment to the ground.

2. The multipurpose golf tool of claim 1, wherein the body section is made of rigid metal or steel.

3. The multipurpose golf tool of claim 1, wherein both tee shaped indentations are deep enough to engage approximately one third of the tee head and a predetermined portion of the tapered tee shank.

4. The multipurpose golf tool of claim 1, wherein each leg bends upwardly at approximately the midsection thereof from the flat body at less than forty-five degrees to accommodate the retrieval of a buried golf tee and to accommodate the middle finger on the golfer hand to provide more leverage for the spike wrench while twisting golf spikes on and off golf shoes.

5. The multipurpose golf tool of claim 2, wherein the rigid metal includes a shiny finish that makes it easy to clean the golf tool while providing long life for the tool.

6. The multipurpose golf tool of claim 1, wherein the various edges, protrusions, grabber, bottle opener, spike wrench and legs have rounded corners and inwardly turned ends to prevent sharp edges that may damage pockets in clothing and the like.

* * * * *